US006960885B2

(12) United States Patent
Kim et al.

(10) Patent No.: US 6,960,885 B2
(45) Date of Patent: Nov. 1, 2005

(54) ELECTRODELESS DISCHARGE LAMP EXCITED USING MICROWAVE ENERGY COUPLED THROUGH A COAXIAL WAVEGUIDE

(75) Inventors: Hyun-Jung Kim, Seoul (KR); Joon-Sik Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 23 days.

(21) Appl. No.: 10/151,095

(22) Filed: May 21, 2002

(65) Prior Publication Data

US 2003/0057842 A1 Mar. 27, 2003

(30) Foreign Application Priority Data

Sep. 27, 2001 (KR) ..... 2001-60190

(51) Int. Cl.[7] ..... H01J 65/04
(52) U.S. Cl. ..... 315/39; 315/248
(58) Field of Search ..... 315/39, 248

(56) References Cited

U.S. PATENT DOCUMENTS 5,525,865 A * 6/1996 Simpson ..... 315/39
5,841,233 A * 11/1998 Ury et al. ..... 315/39
6,046,545 A * 4/2000 Horiuchi et al. ..... 315/39
6,049,170 A * 4/2000 Hochi et al. ..... 315/39

* cited by examiner

*Primary Examiner*—Benny T. Lee
(74) *Attorney, Agent, or Firm*—Birch, Stewart, Kolasch & Birch, LLP

(57) ABSTRACT

In an electrodeless discharge lamp using microwave energy, an electrodeless discharge lamp using microwave energy includes a resonator having an opening portion at the side and forming a resonance region at which microwave energy is resonated, a magnetron having an antenna in order to output microwave energy, a coaxial wave guide installed to the other side of the resonator, transmitting microwave energy from the magnetron to the resonator and having an internal guide extended in the projecting direction of the antenna of the microwave generator, a bulb placed inside the resonator and having enclosed fluorescent materials generating lights by the microwave energy, and a mesh member installed to the opening portion of the resonator, preventing leakage of microwave energy and passing lights generated in the bulb. Accordingly, by reducing a size of a lamp, it can be easily applied to a low-output system required a compact construction such as a projection TV, etc.

21 Claims, 5 Drawing Sheets

ELECTRODELESS DISCHARGE LAMP EXCITED USING MICROWAVE ENERGY COUPLED THROUGH A COAXIAL WAVEGUIDE

BACKGROUND OF THE INVENTION

1. Field of the Invention

The present invention relates to a lighting apparatus using microwave energy, and in particular to an electrodeless discharge lamp using microwave energy which is capable of being applied to various fields by having a compact construction.

2. Description of the Prior Art

An electrodeless discharge lamp emits lights by enclosing a certain amount of inert gas such as argon and materials such as halide, etc. generating plasmas and exciting them with microwave energy. The electrodeless discharge lamp has longer lifespan and shows better lighting efficiency than that of an incandescent lamp and a fluorescent lamp.

FIG. 1 is a longitudinal sectional view illustrating the conventional electrodeless discharge lamp using microwave energy.

As depicted in FIG. 1, the conventional electrodeless discharge lamp using microwave energy includes a casing 101 having a cylindrical shape, a magnetron 103 placed inside the casing 101 and outputting microwave energy, a wave guide 105 placed inside the casing 101 and transmitting the microwave energy, a mesh screen 119 installed to an outlet of the wave guide 105, cutting off the microwave energy and passing lights, a bulb 107 having enclosed inert gas (G) and placed at the central portion of the mesh screen 119, and a reflector 111 fixed to the casing 101 on the circumferential surface of the mesh screen 119 and reflecting lights generated in the bulb 107 toward the front.

The wave guide 105 is formed so as to have a regular square-shaped section in the travel direction of microwave energy in order to transmit microwave energy having a certain frequency, and a high voltage generator 113 is placed so as to be opposite to the magnetron 103 on the basis of the wave guide 105 (placed between them) and provides high voltage power.

A bulb motor 109 connected to the bulb 107 as one body and rotating it is installed to the lower portion of the wave guide 105.

A cooling fan 115 being rotated by the fan motor 116 is installed to the lower portion of the bulb motor 109 in order to cool the magnetron 103 and the high voltage generator 113.

An air guide 117 is formed at the circumference of the cooling fan 115 in order to provide air sucked from outside to the magnetron 103 and the high voltage generator 113 respectively.

The reflector 111 has an internal reflecting surface in order to reflect lights emitted from the bulb 107 toward the front.

In the meantime, microwave energy transmitted to a free space turns into a transmission mode traveling in a direction at a right angle to an electric field and a magnetic field, namely, a TEM (Transverse Electromagnetic) mode.

In contrast, microwave energy transmitted to through a wave guide travels while being reflected at a wall of the wave guide. The microwave energy can be a TE (Transverse Electric) mode at which only an electric field (E) is at a right angle to the travel direction and a magnetic field (H) is a transverse electric wave having elements in the travel direction, or the microwave energy can be a TM (Transverse Magnetic) mode at which only a magnetic field (H) is at a right angle to the travel direction and the an electric field (E) is a transverse magnetic wave having elements in the travel direction.

The TE mode, the TM mode and a mixed mode of the TE and TM modes can be used in the conventional wave guide, herein the TEM mode can not exist in a spherical or cylindrical wave guide but exist in a coaxial line or a twin-lead type feeder, etc.

However, in the conventional electrodeless discharge lamp using microwave energy, in order to transmit microwave energy outputted from a magnetron to a load side, a wave guide placed between a magnetron and a mesh screen and having a certain size in consideration of a standard of a transmission frequency, a TE mode or a TM mode is used or a cylindrical wave guide having a certain diameter is used.

Accordingly, in the conventional electrodeless discharge lamp using microwave energy, because it is impossible to reduce a size of a wave guide, it can not be used as a light source for a low-output system such as a LCD projector and a projection television, etc.

SUMMARY OF THE INVENTION

In order to solve the above-mentioned problem, it is an object of the present invention to provide an electrodeless discharge lamp using microwave energy which is capable of being used for a small apparatus or in a small space by having a compact construction.

In order to achieve the above-mentioned object, an electrodeless discharge lamp using microwave energy in accordance with the present invention includes a resonator having an opening portion at the side and forming a resonance region at which microwave energy is resonated, a microwave generator having an antenna in order to output microwave energy, a coaxial wave guide installed to the other side of the resonator, transmitting microwave energy from the microwave generator to the resonator and having an internal guide extended in the projecting direction of the antenna of the microwave generator, a bulb placed inside the resonator and having enclosed fluorescent materials generating lights by the microwave energy, and a mesh member installed to the opening portion of the resonator, preventing leakage of microwave energy and passing lights generated in the bulb.

The microwave generator, the coaxial wave guide, the resonator, the bulb and the mesh member are combined and arranged in the same axial direction.

The coaxial wave guide is constructed with a cylinder-shaped external guide having a path for transmitting microwave energy and an internal guide extended from the central portion of the external guide toward the projecting direction of the antenna of the microwave generator.

The external guide has an opened structure so as to be directly combined with the microwave generator and has a slot formed at the portion inserted into the resonator in order to output microwave energy.

A matching tune stub is installed to the side of the coaxial wave guide.

A reflector is installed inside the mesh member of the opening portion of the resonator in order to reflect lights generated in the bulb toward the front.

The electrodeless discharge lamp using microwave energy in accordance with the present invention further includes a bulb rotation operating means for rotating the bulb.

The bulb rotation operating means includes a bulb motor supported by the resonator and a motor shaft connected between the bulb motor and the bulb and transmitting a rotational force.

The resonator has a divided space at which the bulb motor is installed.

The microwave generator, the coaxial wave guide and the resonator are placed inside a casing having an opening portion at the side.

A high voltage generator is placed inside the casing in order to provide a boosted high voltage to the magnetron.

A cooling device for cooling the magnetron and the high voltage generator is placed inside the casing.

A suction hole and a discharge hole are formed at the casing in order to circulate external air, and the cooling device includes a fan housing placed inside the casing, a cooling fan installed inside the fan housing and forcibly circulating external air and a fan motor rotating the cooling fan.

In addition, an electrodeless discharge lamp using microwave energy in accordance with the present invention includes a casing having an opening portion at the side, a resonator installed inside the opening portion of the casing and forming a resonance region at which microwave energy is resonated, a magnetron placed inside the casing and having an antenna outputting microwave energy, a coaxial wave guide as a conductor installed between the resonator and the magnetron, transmitting microwave energy from the magnetron to the resonator and having an internal guide extended in the projecting direction of the antenna of the magnetron, a bulb placed inside the resonator and having enclosed fluorescent materials generating lights by the microwave energy, and a mesh member installed to the opening portion of the casing, preventing leakage of microwave energy and passing lights generated in the bulb.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, embodiments of an electrodeless discharge lamp using microwave energy in accordance with the present invention will be described with reference to accompanying drawings.

There can be a plurality of embodiments of an electrodeless discharge lamp using microwave energy in accordance with the present invention, hereinafter preferred embodiments will be described.

Figure 1:
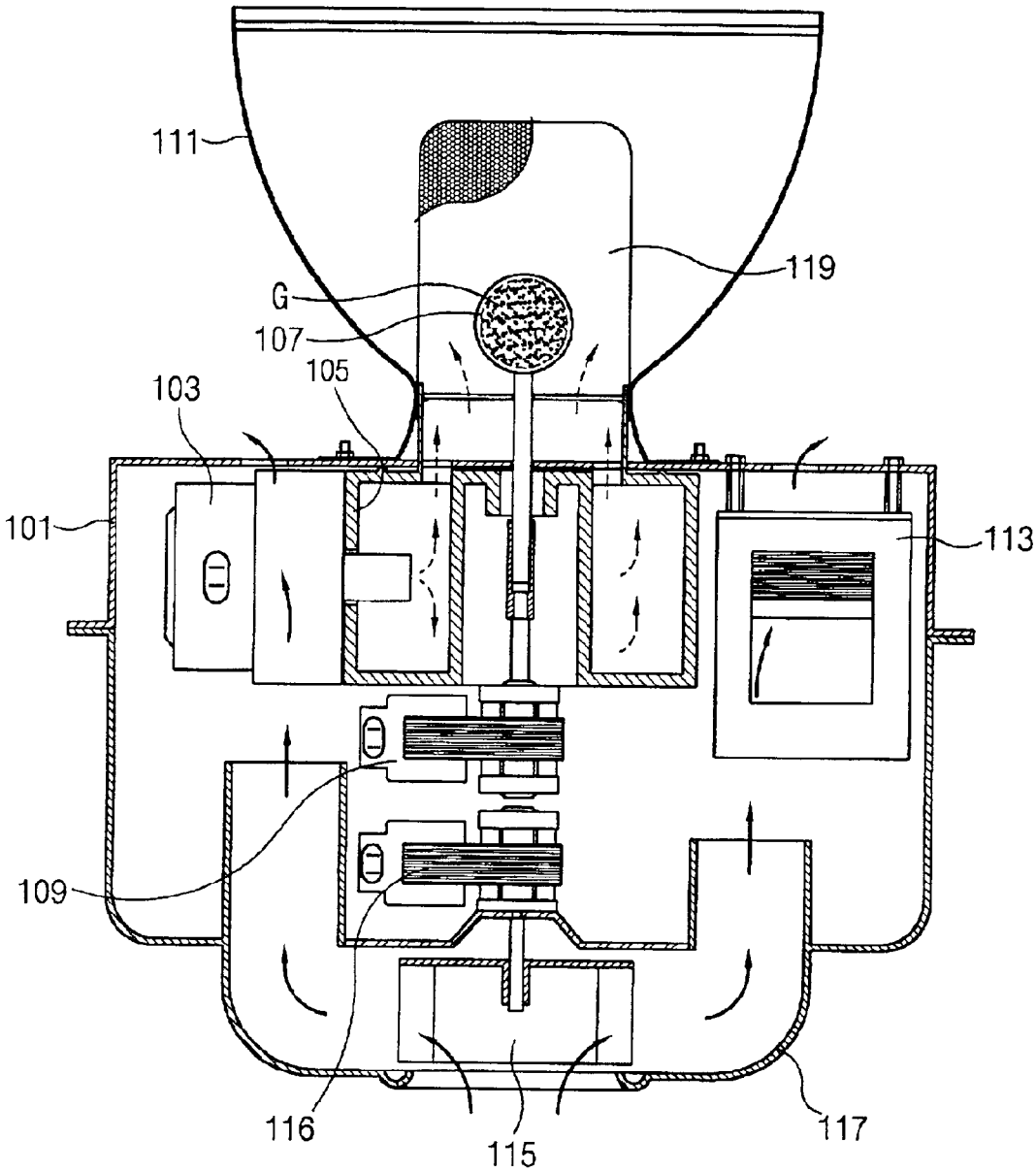
FIG.1 CONVENTIONAL ART
FIG. 1 is a longitudinal sectional view illustrating the conventional electrodeless discharge lamp using microwave energy.
Figure 2:
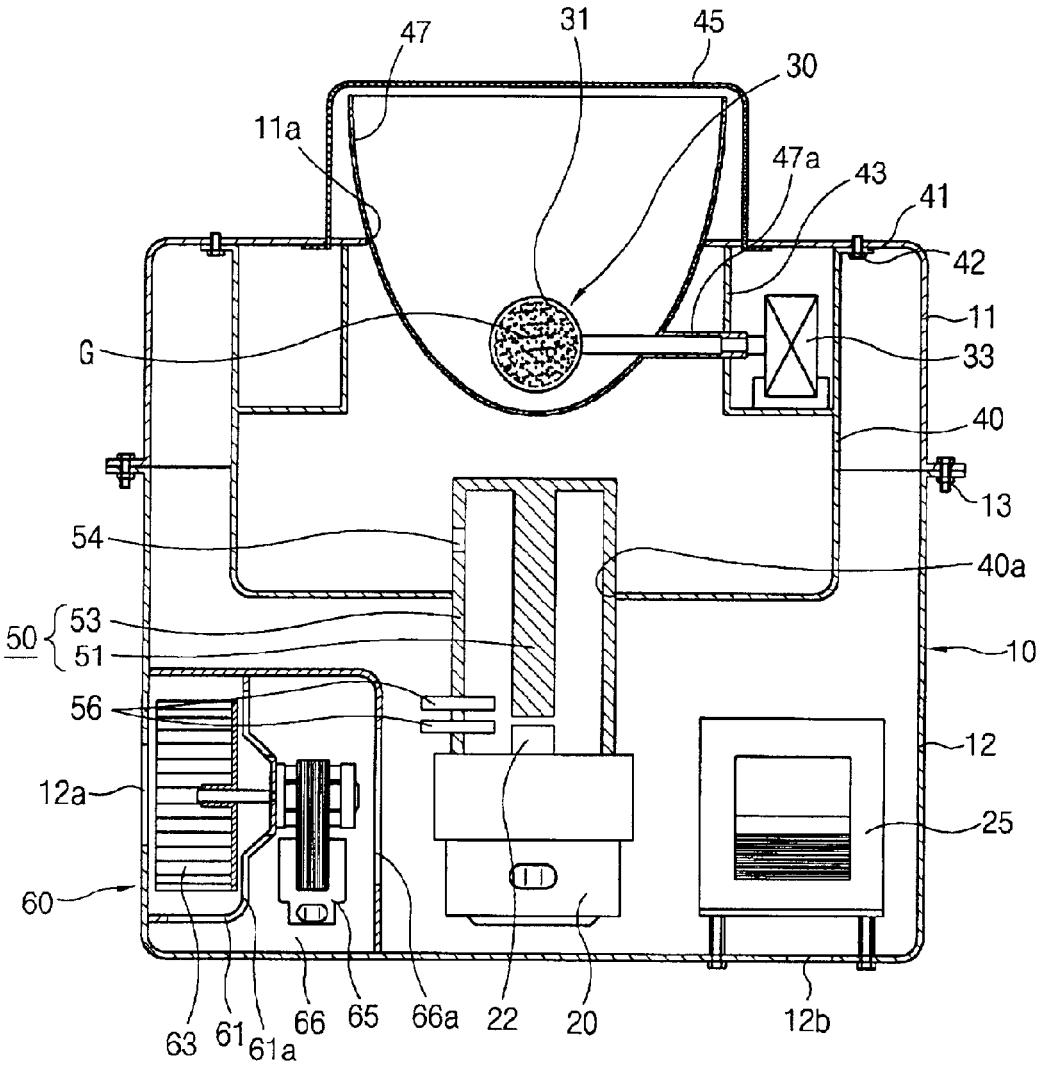
FIG. 2 is a longitudinal sectional view illustrating an electrodeless discharge lamp using microwave energy in accordance with an embodiment of the present invention.
Figure 3:
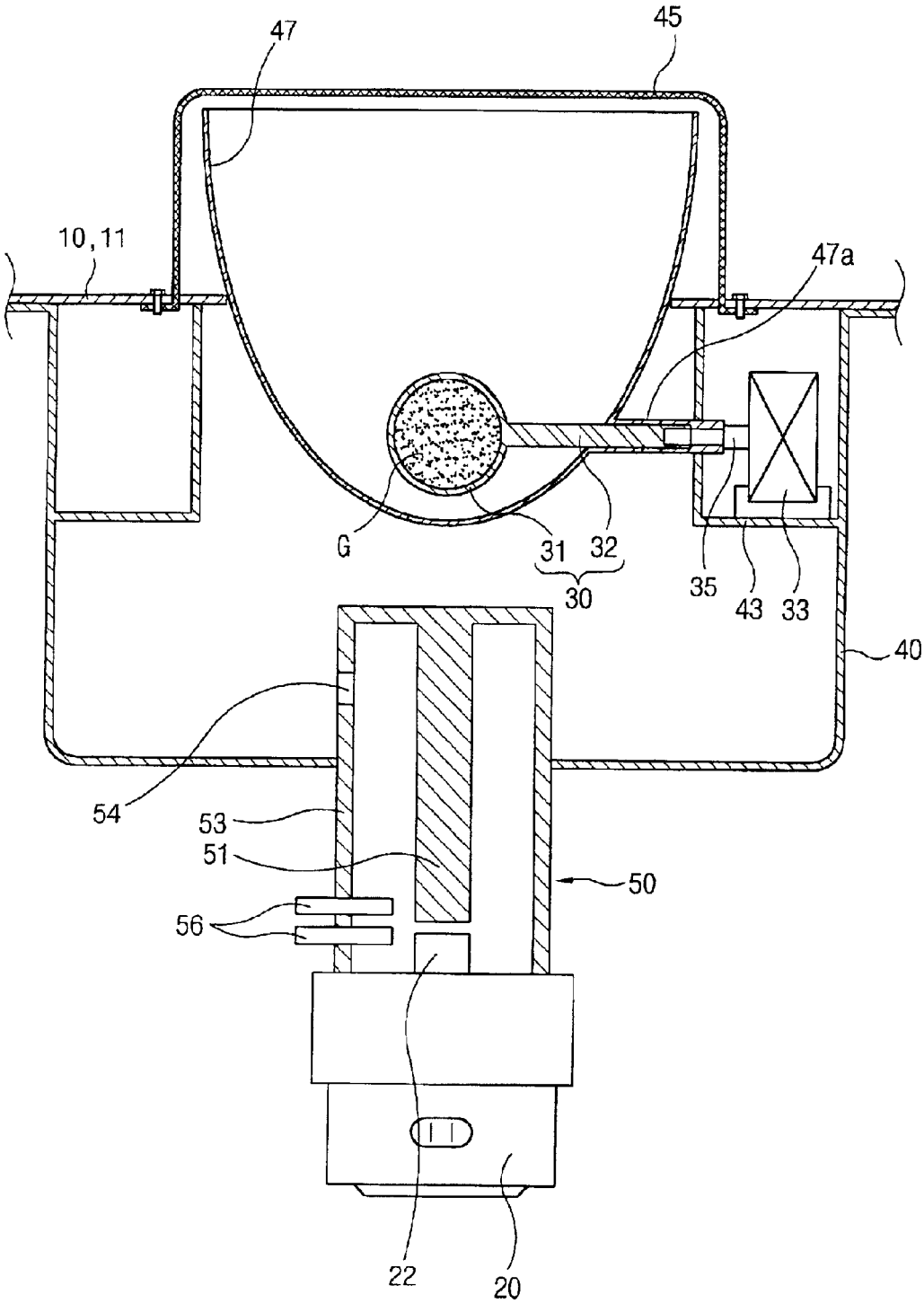
FIG. 3 is an enlarged view illustrating major parts of the electrodeless discharge lamp using microwave energy of FIG. 2.

FIG. 2 is a longitudinal sectional view illustrating an electrodeless discharge lamp using microwave energy in accordance with an embodiment of the present invention, FIG. 3 is an enlarged view illustrating major parts of the electrodeless discharge lamp using microwave energy of FIG. 2, and FIGS. 4A, 4B, 4C, 4D and 4E illustrate shapes of a slot 54 of FIG. 3.

As shown in FIGS. 2 and 3, an electrodeless discharge lamp using microwave energy in accordance with an embodiment of the present invention includes a casing 10 having an opening portion 11*a* (see FIG. 2) at a certain side and a receiving space inside, a resonator 40 installed inside the opening portion 11*a* of the casing 10 and having a resonance region at which microwave energy is resonated, a magnetron 20 placed inside the casing 10 and having an antenna 22 outputting microwave energy, a coaxial wave guide 50 installed between the resonator 40 and the magnetron 20, transmitting microwave energy from the magnetron 20 to the resonator 40 and having an inner guide 51 extended in the projecting direction of the antenna 22, a bulb 30 placed inside the resonator 40 and having enclosed fluorescent materials generating lights by the microwave energy, and a mesh member 45 installed to the opening portion 11*a* of the casing 10, preventing leakage of microwave energy and passing lights generated in the bulb 30.

In the electrodeless discharge lamp, the magnetron 20, the coaxial wave guide 50, the resonator 40, the bulb 30 and the mesh member 45 are combined and arranged inside and outside of the casing 10 in the same axial direction on the basis of the opening portion 11*a*.

A high voltage generator 25 providing a boosted high voltage to the magnetron 20 and a cooling device 60 for cooling the magnetron 20 and the high voltage generator 25 are placed inside the casing 10.

In addition, a reflector 47 reflecting lights generated in the bulb 30 toward the front is installed inside the mesh member 45, and a bulb motor 33 cooling the bulb 30 while rotating is installed inside the resonator 40.

Major parts of the electrodeless discharge lamp in accordance with the embodiment of the present invention will be described in more detail.

As shown in FIGS. 2 and 3, in the casing 10, a front casing 11 and a rear casing 12 are combined to each other by a bolt 13, and a suction hole 12*a* and a discharge hole 12*b* are formed at the rear casing 12 in order to make external air pass through the casing 10 in the operation of the cooling device 60.

Next, the resonator 40 has a cylindrical shape in general, however there also can be a rectangular resonator or a polygonal resonator, the resonator 40 is made of metal materials so as to prevent leakage of microwave energy and lights, has a flange portion 41 on the outer circumferential surface and is fixed inside the front casing 11 by a screw 42.

In addition, in the resonator 40, an opening portion is formed in the same direction of the opening portion 11*a* of the casing 10, and a space divided by a dividing plate 43 is formed in order to install the bulb motor 33 to the circumference of the opening portion of the resonator 40. A wave guide installation hole 40*a* opposite the opening portion of the resonator 40 is formed in order to install the coaxial wave guide 50.

Next, the coaxial wave guide 50 is constructed with an external guide 53 having a cylindrical shape and forming a path for transmitting microwave energy and an internal guide 51 extended from the central portion of the external guide 53 in the projecting direction of the antenna 22 of the magnetron 20.

As shown in FIG. 3, in the external guide 53 having an opened structure so as to be directly combined with the magnetron 20, a slot 54 for outputting microwave energy is formed at a portion inserted into the resonator 40, and a matching tune stub 56 for matching of impedance is placed at the side at which the magnetron 20 is installed.

The inner guide 51 has a length shorter than that of the external guide 53 and is placed so as to have a certain distance from the antenna 22 of the magnetron 20.

Herein, as depicted in FIGS. 4A, 4B, 4C, 4D and 4E, the slot 54 formed at the external guide 53 can be variously formed.

Figure 4A:
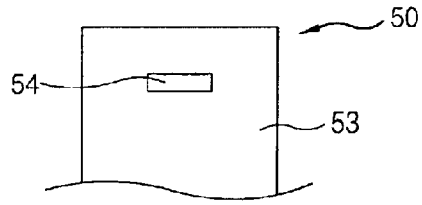
FIGS. 4A, 4B, 4C, 4D and 4E illustrate shapes of a slot of FIG. 3.
Figure 4B:
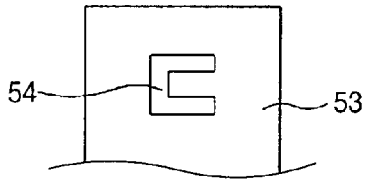
Figure 4C:
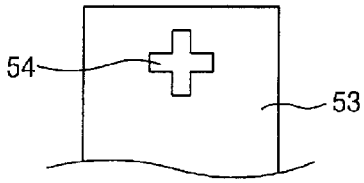
Figure 4D:
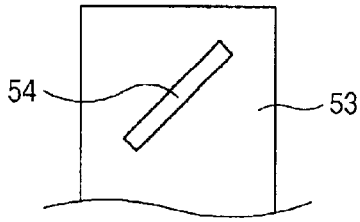
Figure 4E:
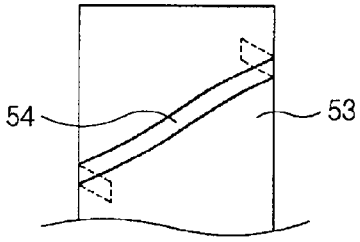

In more detail, as depicted in FIG. 4A, the slot 54 can have a '–' shape in the circumferential direction of the external guide 53, as depicted in FIGS. 4B and 4C, it can have a 'U' shape or a '+' shape. And, as depicted in FIGS. 4D and 4E, it can have a structure slanting to the length direction of the external guide 53 or a spiral shape formed on the circumference of the external guide 53.

In addition, in the present invention, only one slot is formed, however it is also possible to form a plurality of slots according to conditions.

As described above, the slot 54 can have various shapes according to an output range of the magnetron 20 and a design condition of the coaxial wave guide 50.

Next, with reference to FIG. 3, the bulb 30 includes a bulb body 31 having enclosed inert gas (G) in order to emit lights by microwave energy and a bulb stem 32 connected between the bulb body 31 and a motor shaft 35 of the bulb motor 33.

In the present invention, the bulb motor 33 is placed at a space divided by the dividing plate 43 inside the resonator 40, however it is also possible to fix the bulb motor 33 to the exterior of the resonator 40 or the interior of the casing 10 according to design conditions.

Next, in the reflector 47, a reflecting surface having a parabolic shape so as to reflect lights emitted from the bulb 30 toward the front is formed, and the opening portion is exposed through the opening portion 11*a* of the casing 10.

In addition, as shown in FIGS. 2 and 3, in the reflector 47, a shaft tube 47*a* extended as a tube shape is formed in order to support the stem 32 of the bulb 30 rotatively.

The mesh member 45 is made of metal materials having a mesh structure, covers the exterior of the reflector 47 and is fixed to the front surface of the front casing 11.

As shown in FIG. 2, the cooling device 60 includes a fan housing 61 placed inside the rear casing 12, a cooling fan 63 installed inside the fan housing 61 and forcibly circulating air and a fan motor 65 rotating the cooling fan 63.

Herein, in the operation of the cooling fan 63, a flow path is formed through the suction hole 12*a*, a fan housing discharge hole 61*a*, a motor chamber 66, a motor chamber discharge hole 66*a*, inside the casing 10 and the discharge hole 12*b*.

The operation of the electrodeless discharge lamp using microwave energy in accordance with the embodiment of the present invention will be described.

When power is applied to the magnetron 20 by the high voltage generator 25, the magnetron 20 oscillates and discharges microwave energy to the coaxial wave guide 50 through the antenna 22. Herein, the cooling fan 63 installed to the side of the casing 10 operates and cools the magnetron 20 and the high voltage generator by sucking external air into the casing 10.

The microwave energy outputted into the coaxial wave guide 50 from the antenna 22 of the magnetron 20 is transmitted to the resonator 40 through the slot 54 of the coaxial wave guide 50. When the microwave energy is discharged into the resonator 40, materials enclosed in the bulb 30 are excited and emit lights in a plasma state. Herein, because the bulb 30 is rotated by the bulb motor 33, it is cooled without being heated.

The lights generated in the bulb 30 is reflected toward the front by the reflector 47, the mesh member 45 placed in front of the reflector 47 prevents leakage of microwave energy at the resonation region inside the resonator 40 and passes the light generated from the bulb 30, accordingly the lights can be transmitted toward the front.

Figure 5:
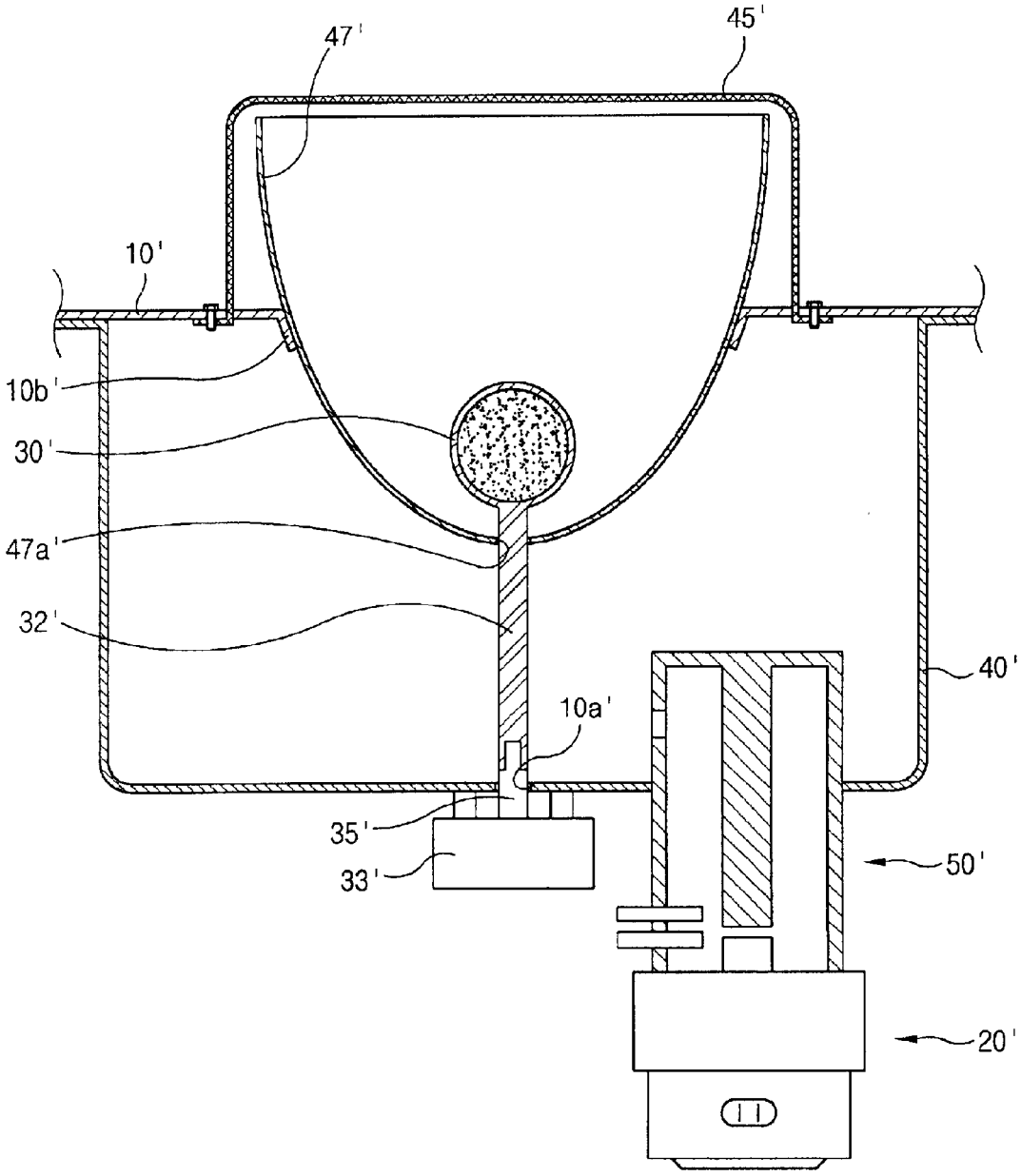
FIG. 5 is an enlarged view illustrating an electrodeless discharge lamp using microwave energy in accordance with another embodiment of the present invention.

FIG. 5 is an enlarged view illustrating an electrodeless discharge lamp using microwave energy in accordance with another embodiment of the present invention.

Unlike the electrodeless discharge lamp using microwave energy in accordance with the embodiment of the present invention, in an electrodeless discharge lamp using microwave energy in accordance with another embodiment of the present invention, because a stem 32' of a bulb 30' and a shaft 35' of a bulb motor 33' are installed so as to be perpendicular to the exterior of the resonator 40', they are placed in the same axial direction with a mesh member 45' and a reflector 47', and a coaxial wave guide 50' and a magnetron 20' are installed to a portion separated from the central portion of the resonator 40' beside the bulb motor 33' in another axial direction.

In more detail, holes 47*a*', 10*a*' are formed at the central portion of the reflector 47' and the casing 10' in order to pass the stem 32' and the motor shaft 35' connecting the bulb 30' and the bulb motor 33', and a bulb motor 33' is fixed to the rear of the casing 10'. Herein, a general sealing structure (not shown) is secured between the hole 10*a*' of the casing 10' and the motor shaft 35' or the bulb motor 33' and the rear surface of the casing 10' in order to prevent leakage of microwave energy or penetration of external air.

And, in the electrodeless discharge lamp using microwave energy in accordance with another embodiment of the present invention, a magnetron 20' and a coaxial wave guide 50' having the same structure as the embodiment of the present invention are installed so as to be parallel with the bulb motor 33' and the stem 32', accordingly microwave energy can be transmitted to the resonator 40'.

In the meantime, a fixation portion 10*b*' is extended-formed at the front surface of the casing 10' in order to fix the reflector 47'. Herein, a fixation method of the reflector 47' such as an adhesion method or a bolting method, etc. can be determined according to design conditions.

In the electrodeless discharge lamp using microwave energy in accordance with another embodiment of the present invention, it is preferable to form rest parts besides the above-described parts so as to have the same construction as the embodiment of the present invention.

A reference numeral 45' is a mesh member passing lights and preventing leakage of microwave energy.

As described above, in an electrodeless discharge lamp in accordance with the present invention, the size of a lamp can be reduced by installing a coaxial wave guide having a compact structure between a magnetron and a resonator in order to transmit microwave energy outputted from the magnetron to the resonator, accordingly it can be easily applied to a low-output system required a compact construction such as a projection TV, etc.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless discharge lamp using the microwave energy, comprising:

a casing having an opening portion at a side thereof;

a resonator installed inside the opening portion of the casing, the resonator having an opening portion at a first side thereof and providing a resonance region at which microwave energy resonates;

a magnetron for generating the microwave energy and placed inside the casing and having an antenna outputting the microwave energy, the antenna having a projecting direction;

a coaxial wave guide, including a conductor installed between the resonator and the magnetron, transmitting the microwave energy from the magnetron to the resonator and having a cylindrical external guide with a path for transmitting the microwave energy an internal guide attached to, and enclosed by a central upper portion of the external guide as to extend in a direction opposite that of the projecting direction of the antenna of the magnetron, the resonator being attached to side portions of the external guide, wherein the external guide is attached to the resonator at an opening portion at a second side of the resonator;

a bulb placed inside the resonator and having enclosed fluorescent materials generating light when excited by the microwave energy; and a mesh member installed to the opening portion of the casing, preventing leakage of the microwave energy and passing the light generated in the bulb.

2. The lamp of claim 1, wherein the magnetron, the coaxial wave guide, the resonator, the bulb and the mesh member are combined and arranged along a same coaxial direction.

3. The lamp of claim 1, wherein a cooling device is placed inside the casing in order to cool units within of the casing.

4. The lamp of claim 1, wherein a reflector is installed inside the mesh member of the opening portion at the first side of the resonator in order to reflect light generated in the bulb.

5. The lamp of claim 1, further comprising:

a bulb rotation operating means for rotating the bulb.

6. The lamp of claim 1, wherein a high voltage generator is placed inside the casing in order to provide a boosted high voltage to the magnetron.

7. An electrodeless discharge lamp using the microwave energy, comprising:

a resonator having an opening portion at a first side and defining a resonance region at which microwave energy resonates;

a microwave generator for generating the microwave energy and having an antenna in order to output the microwave energy, the antenna having a projecting direction;

a coaxial wave guide, installed at an opening portion at another side of the resonator, transmitting the microwave energy from the microwave generator to the resonator and having a cylindrical external guide with a path for transmitting the microwave energy and an internal guide extended from a central upper portion of the external guide in a direction opposite that of the projecting direction of the antenna of the microwave generator, the resonator being attached to side portions of the external guide, wherein the external guide has an opened structure so as to be directly combined with the microwave generator and has a slot disposed at a portion inserted into the resonator in order to output the microwave energy, wherein the slot is disposed lengthwise in the circumferential direction of the external guide, has a "U" shape, has a cross shape, slants in a length direction of the external guide or has a spiral shape on the circumference of the external guide;

a bulb placed inside the resonator and having enclosed fluorescent materials generating light when excited by the microwave energy; and a mesh member installed to the opening portion of the resonator, preventing leakage of the microwave energy and passing the light generated in the bulb.

8. An electrodeless discharge lamp using the microwave energy, comprising:

a resonator having an opening portion at a first side and defining a resonance region at which the microwave energy resonates;

a microwave generator for generating the microwave energy and having an antenna in order to output the microwave energy, the antenna having a projecting direction;

a coaxial wave guide, installed at an opening portion at another side of the resonator, transmitting the microwave energy from the microwave generator to the resonator and having a cylindrical external guide with a path for transmitting the microwave energy and an internal guide, attached to, and enclosed by a central upper portion of the external guide as to extend in a direction opposite that of the projecting direction of the antenna of the microwave generator, the resonator being attached to side portions of the external guide, wherein the external guide is attached to the resonator at said opening portion at another side of the resonator;

a bulb placed inside the resonator and having enclosed fluorescent materials generating light when excited by the microwave energy; and a mesh member installed to the opening portion of the resonator, preventing leakage of microwave energy and passing the light generated in the bulb.

9. The lamp of claim 8, wherein the microwave generator, the coaxial wave guide, the resonator, the bulb and the mesh member are combined and arranged along a same axial direction.

10. The lamp of claim 8, wherein the resonator, the bulb and the mesh member are combined and arranged along a same axial direction, and the microwave generator and the coaxial wave guide are arranged in another axial direction adjacent to the axial direction of the resonator, the bulb and the mesh member.

11. The lamp of claim 8, wherein a tuned matching stub is installed to a side of the coaxial wave guide.

12. The lamp of claim 8, wherein a reflector is installed inside the mesh member at the opening portion at a the first side of the resonator in order to reflect the light generated in the bulb.

13. The lamp of claim 8, further comprising:

a bulb rotation operating means for rotating the bulb.

14. The lamp of claim 13, wherein the bulb rotation operating means includes a bulb motor supported by the resonator and a motor shaft connected between the bulb motor and the bulb and transmitting a rotational force.

15. The lamp of claim 14, wherein the bulb rotation operating means is placed so as to pass the center of the resonator, and the coaxial wave guide is placed at a portion separated from the center of the resonator.

16. The lamp of claim 8, wherein the external guide has an opened structure so as to be directly combined with the microwave generator and has a slot disposed at a portion inserted into the resonator in order to output the microwave energy.

17. The lamp of claim 8, wherein the microwave generator, the coaxial wave guide and the resonator are placed inside a casing having an opening portion at a side thereof.

18. The lamp of claim 17, wherein the microwave generator is a magnetron, a high voltage generator is placed inside the casing in order to provide a boosted high voltage to the magnetron.

19. The lamp of claim 18, wherein a cooling device for cooling the magnetron and the high voltage generator is placed inside the casing.

20. The lamp of claim 19, wherein a suction hole and a discharge hole are disposed at the casing in order to circulate external air, and the cooling device includes a fan housing placed inside the casing, a cooling fan installed inside the fan housing and forcibly circulating external air and a fan motor rotating the cooling fan.

21. An electrodeless discharge lamp using the microwave energy, comprising:

a resonator having an opening portion at a first side and defining a resonance region at which microwave energy resonates;

a microwave generator for generating the microwave energy and having an antenna in order to output the microwave energy, the antenna having a projecting direction;

a coaxial wave guide, installed at an opening portion at another side of the resonator, transmitting the microwave energy from the microwave generator to the resonator and having a cylindrical external guide with a path for transmitting the microwave energy and an internal guide extended from a central upper portion of the external guide in a direction opposite that of the projecting direction of the antenna of the microwave generator, the resonator being attached to side portions of the external guide;

a bulb placed inside the resonator and having enclosed fluorescent materials generating light when excited by the microwave energy;

a mesh member installed to the opening portion of the resonator, preventing leakage of the microwave energy and passing the light generated in the bulb; and a bulb rotation operating means for rotating the bulb, wherein the bulb rotation operating means includes a bulb motor supported by the resonator and a motor shaft connected between the bulb motor and the bulb and transmitting a rotational force and wherein the resonator has a divided space at which the bulb motor is installed.

* * * * *